US011287115B2

(12) United States Patent
Sarels

(10) Patent No.: US 11,287,115 B2
(45) Date of Patent: Mar. 29, 2022

(54) ILLUMINATED SIGN HAVING AN ELECTRICAL CABLE WITH A VERTICAL STRUCTURE

(71) Applicant: Kaiwen Consulting, Marcq-en-Baroeul (FR)

(72) Inventor: Kevin Sarels, Marcq-en-Baroeul (FR)

(73) Assignee: KAIWEN CONSULTING, Marcq-en-Baroeul (FR)

( * ) Notice: Subject to any disclaimer, the term of this patent is extended or adjusted under 35 U.S.C. 154(b) by 0 days.

(21) Appl. No.: 17/055,454

(22) PCT Filed: Jul. 22, 2019

(86) PCT No.: PCT/FR2019/051821
§ 371 (c)(1),
(2) Date: Nov. 13, 2020

(87) PCT Pub. No.: WO2020/021190
PCT Pub. Date: Jan. 30, 2020

(65) Prior Publication Data

US 2021/0180777 A1 Jun. 17, 2021

(30) Foreign Application Priority Data

Jul. 24, 2018 (FR) ..... 1856829

(51) Int. Cl.
*F21V 21/002* (2006.01)
*F21V 23/00* (2015.01)
(Continued)

(52) U.S. Cl.
CPC ..... *F21V 21/002* (2013.01); *F21V 23/002* (2013.01); *F21V 23/003* (2013.01);
(Continued)

(58) Field of Classification Search
None
See application file for complete search history.

(56) References Cited

U.S. PATENT DOCUMENTS 5,310,355 A 5/1994 Dannatt
6,657,381 B1 * 12/2003 Arutaki ..... H01R 4/2406 313/512

(Continued)

FOREIGN PATENT DOCUMENTS

BE 401665 A 3/1934
DE 4310440 A1 2/1994

(Continued)

OTHER PUBLICATIONS

International Search Report from PCT/FR2019/051821 dated Nov. 7, 2019, 3 pgs.

*Primary Examiner* — Elmito Breval
(74) *Attorney, Agent, or Firm* — Tutunjian & Bitetto, P.C.

(57) ABSTRACT

The present invention relates to a lighting fixture having a plurality of light sources positioned at the front of a support plate. The light sources each having at least a first and a second electrical terminal. The support plate includes an upper conductive layer and a lower conductive layer. The upper and lower layers are electrically insulated from one another by an intermediate insulating layer, and in that, for each light source, the first and the second electrical terminals are electrically connected respectively to the upper and lower layer, or conversely.

27 Claims, 5 Drawing Sheets

FIG. 2

(51) Int. Cl.

| | |
|---|---|
| ***G09F 13/04*** | (2006.01) |
| ***G09F 13/22*** | (2006.01) |
| *F21Y 115/10* | (2016.01) |

(52) U.S. Cl.
CPC ..... *G09F 13/0404* (2013.01); *G09F 13/22* (2013.01); *F21Y 2115/10* (2016.08); *G09F 2013/222* (2013.01)

(56) References Cited

U.S. PATENT DOCUMENTS

| | | | | |
|---|---|---|---|---|
| 2015/0185137 | A1* | 7/2015 | Amari ..... | G01N 21/25 356/237.1 |
| 2016/0014878 | A1* | 1/2016 | Kilhenny ..... | H05K 3/0094 257/99 |

FOREIGN PATENT DOCUMENTS

| | | | |
|---|---|---|---|
| DE | 10144206 | A1 | 4/2003 |
| EP | 1167867 | A2 | 1/2002 |
| WO | 2009101561 | A1 | 8/2009 |
| WO | 2018150408 | A1 | 8/2018 |

* cited by examiner

ILLUMINATED SIGN HAVING AN ELECTRICAL CABLE WITH A VERTICAL STRUCTURE

TECHNICAL FIELD AND PRIOR ART

The present invention relates to the field of lighting fixtures, and particularly that of illuminated signs.

The subject matter of the present invention relates more specifically to a quality lighting fixture both in terms of lighting and operating temperature control as well as to the manufacturing method associated therewith.

The present invention will find numerous advantageous applications, particularly for signs such as for example store signs which are generally custom-made on a unitary basis or in small quantities.

Further advantageous applications could also be considered for the design of other lighting fixtures of the light fitting and/or illuminated decoration type.

The desired features for a high-quality illuminated sign are as follows:

homogeneous illumination;

satisfactory mechanical resistance and satisfactory reliability; and compact size and slimline design.

At the present time, in order to obtain satisfactory lighting homogeneity and a slimline design for a sign, LEDs (acronym of "Light-Emitting Diodes") are preferably used.

A LED source can be implemented in several ways when manufacturing an illuminated sign.

Thus far, this manufacture is directly associated with the products and the electronic components available on the market via manufacturers.

Conventionally, LEDs are offered particularly in the form of chains, strips, sheets or individually, each type of LED can serve for the manufacture of a different type of illuminated sign based on the need and the manufacturing method used.

In FIGS. 1*a*-1*b* and 1*c* appended to the present description, the scenario of a 120 millimeter high letter "G" in "Times New Roman" font to be illuminated is taken by way of example and will be described according to the main manufacturing methods used to date.

According to the first example in FIG. 1*a*, the letter "G" is herein embodied according to the so-called "module" method.

This is the most commonly used method; it essentially consists of disposing LED modules in series so as to create the desired shape.

The Applicant suggests however that this method is not satisfactory as it does not always enable small shapes to be homogeneously illuminated.

In the example of the 120 millimeter "G" illustrated herein, it is not possible to dispose the modules in the thinnest parts: the lighting obtained is therefore not optimal.

In the second example in FIG. 1*b*, the insertion of a LED strip on the support is considered to form the letter "G". Inserting such a LED strip enables the light to be placed in much smaller shapes.

The distribution of the LED points is however not homogeneous as can be seen in FIG. 1*b*. Furthermore, the LED strip is subject to considerable stress (twisting, heat, cuts, etc.).

For these reasons, this so-called "LED strip" method is not generally synonymous with high-quality signs.

Better results can be obtained in terms of lighting according to a third so-called "individual LED" method. This method illustrated in FIG. 1*c* is however rarely used given the labor required to apply the method to different and varied shapes.

For each desired shape, it is indeed necessary to wire the resistors and the LEDs suitable to form a custom electric circuit where each LED point is positioned optimally.

For this method, it is therefore necessary to consider considerable extra time for the design of the electric circuit and the layout of all the components.

The fourth method known to date is the so-called "printed circuit" method (not illustrated herein). This method consists of creating a printed circuit containing all of the LEDs and the resistors of the individual method but industrially.

This method is very effective for mass-produced signs, but it requires the development of the printed circuit, the creation of a negative for printing the copper plates and heavy-duty tools for the industrial process.

These tools are not suitable for unitary productions or small production runs which characterize illuminated signs.

All of the above methods have the common point of being difficult to industrialize in the case of unitary production, as is the case generally in the production of illuminated signs.

A large portion of the cost is therefore associated with labor.

Whether for disposing modules (module method), inserting strips (LED strip method), soldering LEDs individually (individual LED method) or indeed creating a printed circuit containing all of the LEDs and resistors (printed circuit method), there is no simple method to date suitable for automating the insertion of the LED components in a random shape.

The Applicant thus suggests that the design of the illuminated signs proposed to date does not enable at the same time homogeneous lighting, a controlled operating temperature and a reduced production cost in particular.

SUBJECT MATTER AND SUMMARY OF THE PRESENT INVENTION

The aim of the present invention is that of improving the situation described above.

The present invention therefore aims to remedy the various drawbacks mentioned above by proposing a circuit structure and electrical wiring that are innovative enabling the design of a lighting fixture providing custom-made and one-off illuminated shapes and offering high-quality homogeneous lighting.

The subject matter of the present invention relates according to a first aspect to a lighting fixture comprising a plurality of light sources positioned at the front of a support plate.

Preferably, the light sources are positioned according to a defined layout to form a predetermined lighting pattern.

According to the present invention, the light sources each have at least a first and a second electrical terminals.

In a first embodiment of the present invention, light sources are used each having first and second terminals respectively having a first and a second conductive rods of different lengths.

In a second embodiment of the present invention, SMD LED type light sources are used to be surface-mounted on the plate (SMD type technology—for "Surface-Mounted Device"). In this embodiment, the first and second terminals of each of the sources have no conductive rods. The surface of the component supporting the terminals is substantially flat: the first and second terminals are mere contactors forming a connection pin.

According to the present invention, the support plate comprises an upper conductive layer and a lower conductive layer, the upper and lower layers being electrically insulated from one another by an intermediate insulating layer.

According to the present invention, the first and second electrical terminals of each light source are electrically connected respectively to the upper and lower layers by vertical wiring, or conversely.

It is understood herein that the upper and lower layers are connected to the same electrical generator.

The sandwich structure considered within the scope of the present invention with two conductive layers separated from one another by an insulating layer enables a quality lighting fixture to be designed in terms of lighting and operating temperature control while being simple to implement.

This structure differs from that proposed with the individual LED method particularly in that, according to the present invention, the two terminals of each light source are connected respectively between the upper and lower layers forming two separate horizontal planes electrically insulated from one another.

It is understood herein that all of the light sources are therefore wired simultaneously by supplying the light sources with two stacked horizontal layers of conductive materials.

Unlike the individual LED method, the light sources are not wired on a horizontal plane thanks to an electric circuit, but on a vertical plane by establishing via the LED components electrical contact of the two separate conductive layers at two different heights.

In an embodiment of the present invention, the first and second terminals respectively have a first and a second conductive rod of different lengths.

In one case, the first rod of the first terminal is shorter than the second rod of the second terminal. In this case, the first terminal is electrically connected to the upper layer and the second terminal is electrically connected to the lower layer.

In the other case, it will be understood that the first rod of the first terminal is longer than the second rod of the second terminal. In this case, the first terminal is electrically connected to the lower layer and the second terminal is electrically connected to the upper layer.

Advantageously, the support plate includes, for each light source, a first hole opening onto the front and traversing at least partially the upper layer.

In an advantageous embodiment, the first hole is sized to receive the first or second electrical terminal (that electrically connected to the upper layer) in order to establish an electrical contact point between the light source and the upper layer.

It is understood herein that such a first hole is sized to receive the first or the second conductive rod of the light source.

In a further embodiment of the present invention, a light source is used wherein the first and second terminals have no conductive rods. The terminals are flat.

To establish an electrical contact point between the source and the upper layer, this embodiment uses an electrical bridge; such an electrical bridge enables an electrical connection between one of the flat terminals of the light source and the upper layer to be established.

A specific plate structure is herein used for this further embodiment.

Preferentially, the plate comprises at the front a first insulating layer; this upper conductive layer is therefore sandwiched between the intermediate insulating layer and the first insulating layer.

Preferentially, the first hole traverses the first insulating layer to open at the front.

Preferentially, a first electrical bridge is housed inside said first hole, said first electrical bridge electrically connecting the upper layer to the front to establish at the front an electrical contact point between the first or second electrical terminal of the light source and the upper layer.

Preferentially, the first electrical bridge is electrically insulated by an insulating sheath.

The whole formed by the hole and the electrical bridge forms an electronic via. Such a via is thus presented in the form of a so-called metallized hole suitable for establishing an electrical connection between the two conductive layers of the plate.

Advantageously, the support plate includes, for each light source, a second hole opening onto the front of the plate and traversing the upper layer, the insulating layer and at least partially the lower layer.

In the embodiment using electrical terminals having conductive rods of different lengths, the second hole is sized to receive the second or first electrical terminal (that electrically connected to the lower layer) in order to establish an electrical contact point between the light source and the lower layer.

It is understood herein that such a second hole is sized to receive the second or first conductive rod of the light source.

In the other embodiment using flat electrical terminals, the use of an electronic via is featured again to electrically connect one of the terminals of the light source to the lower layer.

In this embodiment, the plate thus comprises at the front a second insulating layer; said lower conductive layer is thus sandwiched between the intermediate insulating layer and the second insulating layer.

Preferentially, a second electrical bridge is housed inside said second hole, said second electrical bridge electrically connecting said lower layer to the front to establish at the front an electrical contact point between the second or first electrical terminal of the light source and the lower layer.

Preferentially, the second electrical bridge is electrically insulated by an insulating sheath.

Thus, in the embodiment using SMD LED type LEDs with flat terminals for CMS type surface mounting, the present invention considers the use of an electronic board with a grid enabling a plurality of predefined location possibilities. Each potential location for a LED enables the link to be created between the upper layer by means of two mutually insulated electric contact points and the two, so-called central, conductive layers of the electronic board. These links are created using internal electronic vias in the board.

In this embodiment with a multilayer structure having five layers, the two central conductive layers (positive and negative) have the function of distributing the electrical load homogeneously over all of said electronic board: the presence of these two central conductive layers enables the electrical load to be distributed.

Preferentially, vertical wiring of these two conductive layers to an additional layer at the back can furthermore be considered. It thus becomes possible to select positive contact zones and negative contact zones on this layer to optionally facilitate wiring or indeed conduct future tests. Advantageously, fastening means having conductivity properties are used at the level of each of the electrical contact points to secure each of the light sources on the support plate while ensuring electrical conductivity between each of the sources and respectively the upper and lower layers.

According to a preferred alternative embodiment, the fastening means include a conductive adhesive.

Preferably, this conductive adhesive is an epoxy type adhesive mixed with conductive particles such as for example silver or tin in particular.

According to a further alternative embodiment, the fastening means include a solder.

Such a solder is therefore used at the level of each of the electrical contact points so as to ensure a rigid assembly between each of the sources and the upper and lower layers while ensuring electrical conductivity.

Advantageously, the first and second electrical terminals of each of the light sources are electrically insulated respectively from the lower and upper layers, or conversely.

In an advantageous embodiment of the present invention with a second hole as above, it is furthermore considered that the support plate has a third, so-called blind, hole, opening onto the front and traversing the upper layer and at least partially the insulating layer.

In this embodiment, the blind hole is preferably substantially centered on the second hole and has a greater diameter than the second hole so as to electrically insulate the upper layer and the second or first electrical terminal which is electrically connected to the lower layer.

It is understood herein that the second and third layers are coaxial and that the third hole, which is not as deep as the second hole, has a greater diameter than the latter so as to electrically insulate the upper layer and the electrical terminal which is electrically connected to the lower layer.

Advantageously, the fixture according to the present invention includes electrical power supply means respectively connected to the upper and lower layers to supply each of the light sources with direct current.

In a preferred embodiment, it is considered that the support plate includes a glass fiber panel covered with two copper plates. In this embodiment, the panel serves as an insulating layer and the two copper plates serve respectively as upper and lower layers.

Preferably, the light sources include at least one LED type light-emitting diode and/or an individual module receiving an SMD ("Surface-Mounted Device") LED type light-emitting diode.

Preferably, each light source is presented in the form of an electronic component configured to withstand a voltage of 12 Volts and including an individual LED and a micro-resistor, encapsulated in a resin capsule.

The subject matter of the present invention relates according to a second aspect to a method for manufacturing a lighting fixture comprising a plurality of light sources positioned at the front of a support plate, each light source having at least a first and a second electrical terminals.

According to the present invention, the method includes the following steps:

- providing a support plate comprising an upper conductive layer and a lower conductive layer, the upper and lower layers being electrically insulated from one another by an intermediate insulating layer, and
- an electrical connection step during which the first and second electrical terminals of each light source are electrically connected respectively to the upper and lower layers, or conversely.

This manufacturing technique thus enables light sources of the LED type for example individually on a support to be implemented, in an automatable manner.

Advantageously, the method according to the present invention includes, prior to the electrical connection step, a first machining step during which the support plate is machined so as to form a first hole opening onto the front and traversing at least partially the upper layer.

In an embodiment (herein referred to as the first embodiment) using a light source having electrical terminals presented in the form of conductive rods of different lengths, it is possible to consider during this machining that the first hole is preferably sized to receive the first or second electrical terminal (herein the shortest conductive rod) in order to establish an electrical contact point between the light source and the upper layer.

In a further advantageous embodiment (herein referred to as the second embodiment) using a light source having flat electrical terminals (SMD LED for example), the support plate further comprises a first insulating layer covering the upper conductive layer. In this embodiment, it is considered during this machining to machine the support plate such that the first hole traverses said first insulating layer.

Advantageously, the method according to the present invention includes, prior to the electrical connection step, a second machining step during which the support plate is machined so as to form a second hole opening onto the front and traversing the upper layer, the insulating layer and at least partially the lower layer.

During this machining, it is considered in the first embodiment that the second hole is preferably sized to receive the second or first electrical terminal in order to establish an electrical contact point between the light source and the lower layer.

Advantageously, the electrical connection step includes the use at the level of each of the electrical contact points of fastening means (such as for example a solder or an epoxy type conductive adhesive mixed with conductive particles such as for example silver or tin) to secure each of the sources on the support plate while ensuring the electrical conductivity between each of the sources and respectively the upper and lower layers.

Preferably, during the electrical connection step, the first and second electrical terminals of each light source are electrically insulated respectively from the lower and upper layers, or conversely.

Advantageously, the method according to the present invention includes, prior to the electrical connection step, a third machining step during which the support plate is machined so as to form a third, so-called blind, hole opening onto the front and traversing the upper layer and at least partially the intermediate insulating layer.

During this machining, the blind hole is substantially centered on the second hole and has a greater diameter than the second hole so as to electrically insulate the upper layer and the second or first electrical terminal which is electrically connected to the lower layer.

The method also considers a preliminary step of generating a computer file particularly comprising a defined layout for correctly and optimally positioning the light sources according to predefined criteria to form a predetermined lighting pattern.

The subject matter of the present invention relates according to a third aspect to a use of a lighting fixture as described above for an illuminated sign.

Thus, the present invention, through the various structural and function technical features thereof, proposes a novel design of an illuminated sign with vertical wiring suitable for solving the various problems encountered to date with existing solutions, namely:

- difficulty distributing the light sources optimally for homogeneous lighting;

impossibility of including a LED module in a narrow shape (less than 10 mm) and connecting the shape electrically;

rise in the operating temperature of the light sources in the case where they are highly concentrated (particularly for the LED strip);

time required with existing methods to select the location of each light source (each module, the route of the LED strip or indeed the positioning of each LED and each resistor);

time required for electrical connection of all these methods, soldering, wiring, etc.;

difficulty automating positionings and solders for custom-made products;

need for production runs of identical parts to consider industrial production.

BRIEF DESCRIPTION OF THE APPENDED FIGURES

Further features and advantages of the present invention will emerge from the description hereinafter, with reference to appended FIGS. 2 to 6 which illustrate two embodiment examples thereof which are in no way restrictive and wherein:

FIG. 1*a* is a first example showing the module method for illuminating a sign, according to the prior art, FIG. 1*b* is a second example showing the insertion of an LED strip for illuminating a sign, according to the prior art, and FIG. 1*c* is a third example showing individual LED method for illuminating a sign, according to the prior art.

Figure 5A:
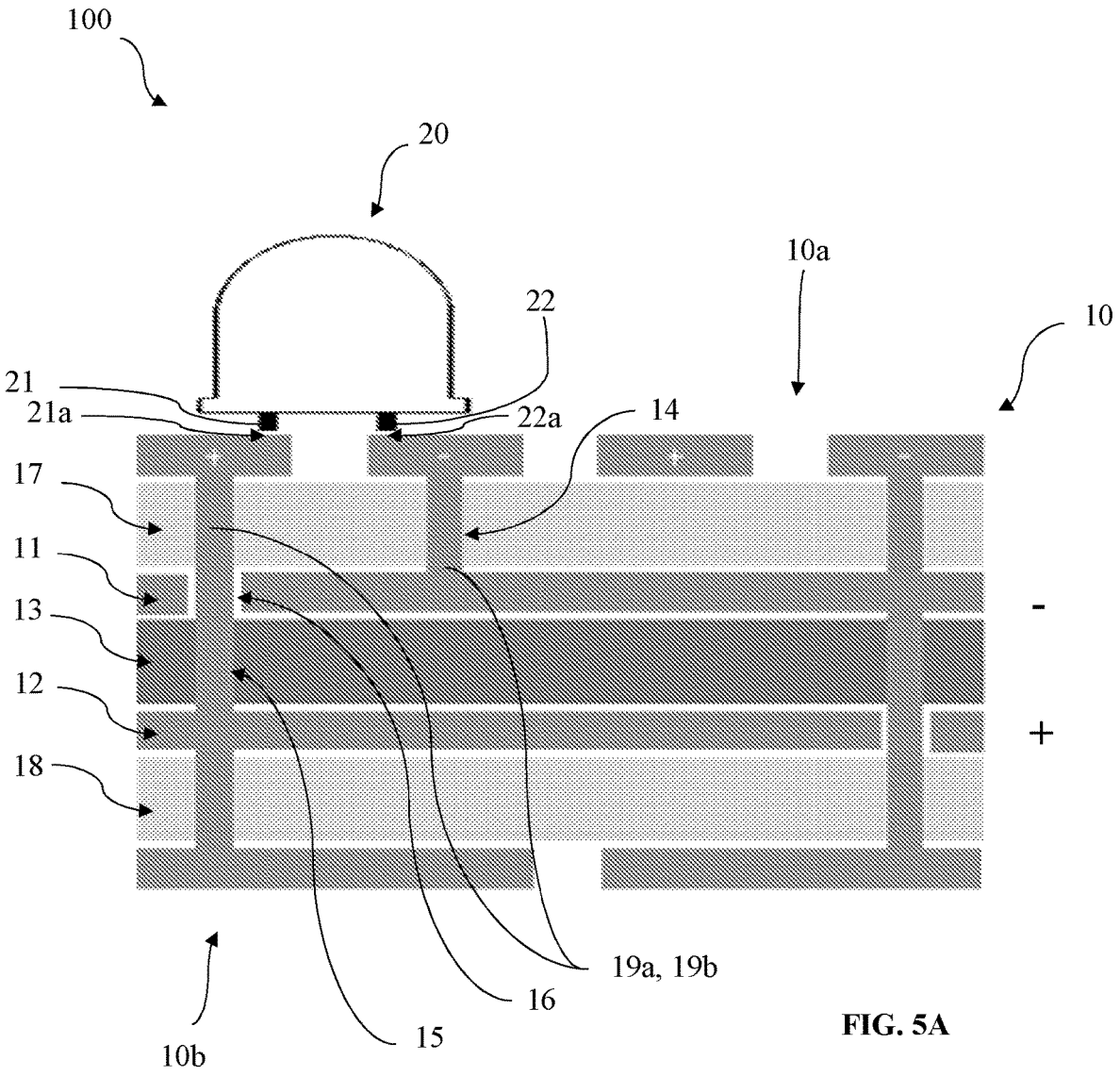
Figure 5B:
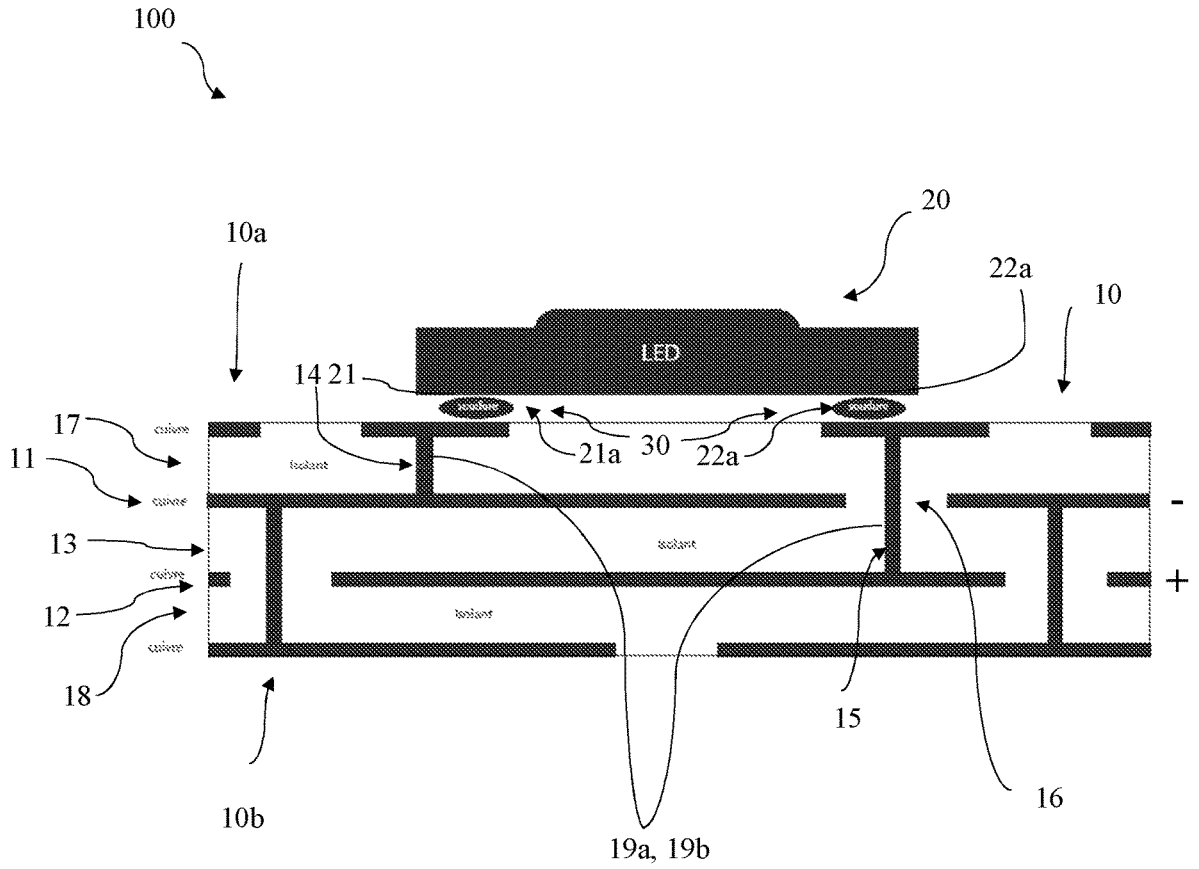
Figure 6:
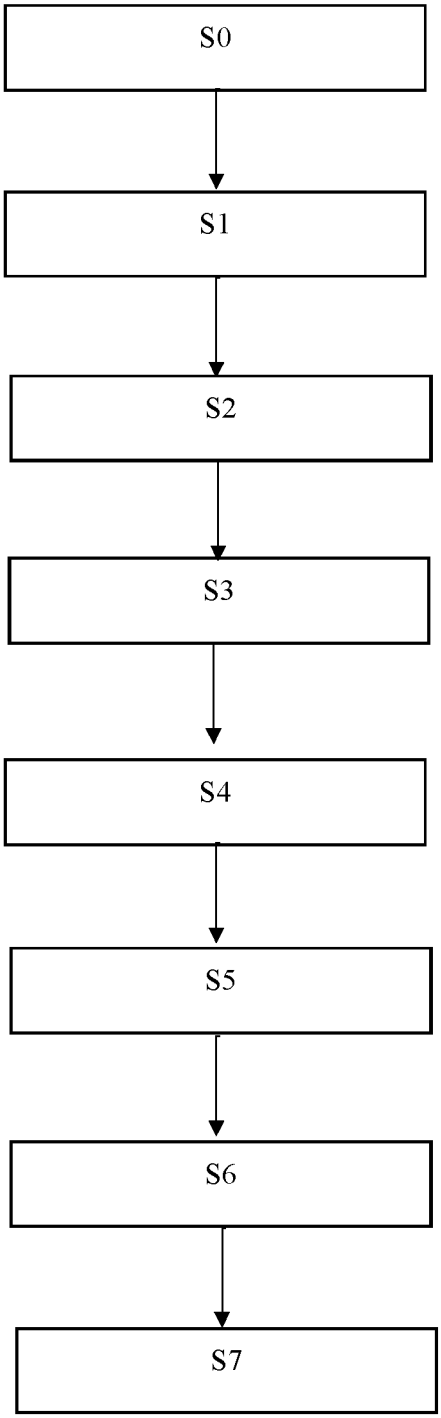

FIGS. 5A and 5B each represent schematically a cross-sectional view of a lighting fixture having a support plate whereon the LED type light sources are wired according to a second embodiment example of the present invention;

FIG. 6 represents a flow chart of a method for manufacturing a lighting fixture according to an embodiment example of the present invention.

DETAILED DESCRIPTION ACCORDING TO AN ADVANTAGEOUS EMBODIMENT

The manufacture of an illuminated sign according to two embodiment examples will now be described hereinafter with reference collectively to FIGS. 2 to 6.

By way of reminder, one of the aims of the present invention is that of devising an illuminated sign suitable for addressing a problem of producing a custom-made and one-off illuminated shape offering quality lighting, i.e., homogeneous and limiting operating heat.

The two examples described herein will each relate to the design of an illuminated sign; it will be understood however that the invention can be implemented for any lighting or illuminated decoration product, and particularly any lighting fixture which requires a custom-made and one-off shape.

The manufacturing method developed within the scope of the present invention and which will be described hereinafter in the description enables LED type individual light sources to be implemented on a support in an automatable manner.

The term LED source in the general sense will be referred to herein.

The underlying concept of the present invention consists of a manufacturing method aiming to wire all of the light sources 20, herein LEDs, simultaneously by supplying the LED sources by two stacked layers of conductive materials.

In the example described herein, individual LED components suitable for 12 Volts are used, and not 3.3 Volt LEDs as is generally the case on existing signs.

Such a LED component is presented in the form of a resin capsule including the LED per se and a micro-resistor. Such a component is thus configured to withstand a voltage of 12 Volts.

The method used is closest to the individual LED method which enables the best quality product to be obtained in terms of lighting and operating temperature control.

However, unlike this method, each LED source is no longer wired on a horizontal plane thanks to an electric circuit, but on a vertical plane by establishing electrical contact between the two separate conductive layers at two different heights.

Figure 1A:
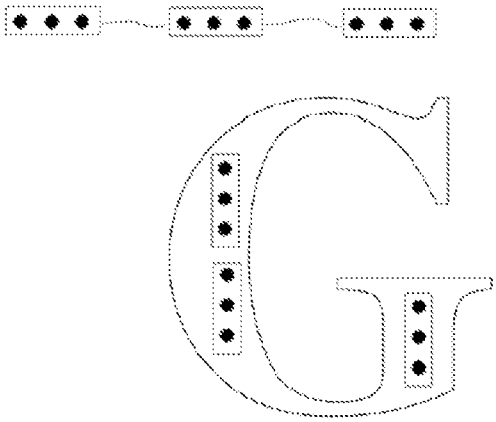
FIG. 1a (Prior Art)
Figure 1B:
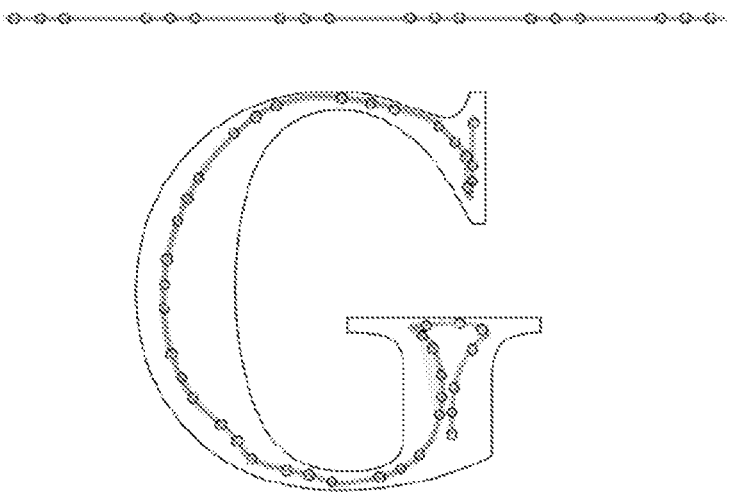
FIG. 1b (Prior Art)
Figure 1C:
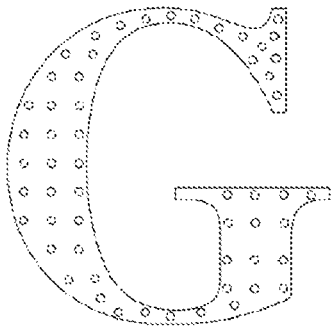
FIG. 1c (Prior Art)
Figure 2:
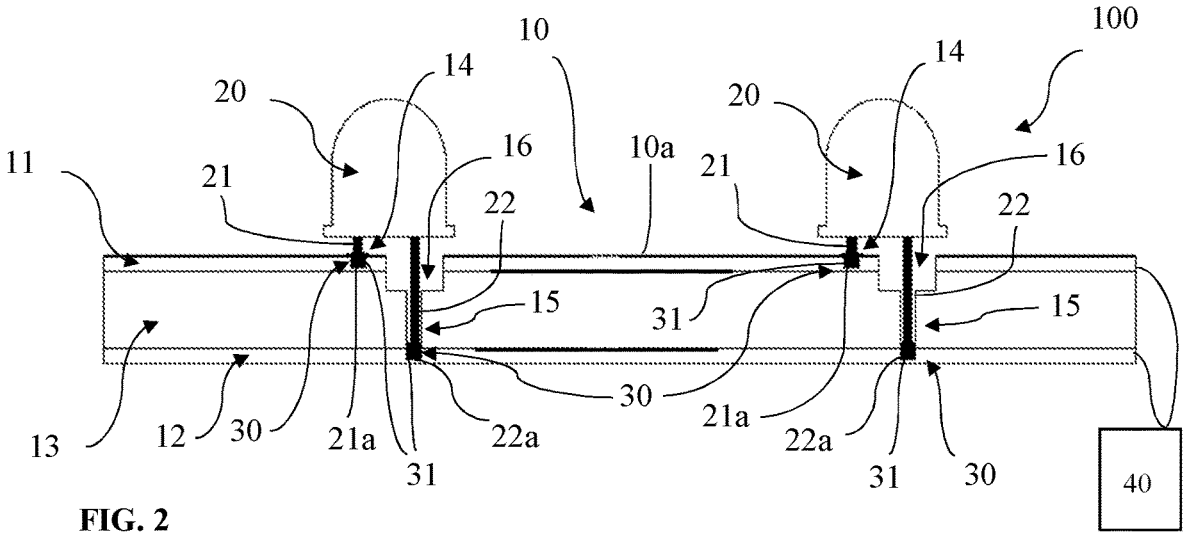
FIG. 2 represents schematically a cross-sectional view of a lighting fixture having a support plate whereon the LED type light sources are wired according to a first embodiment example of the present invention.

In the first embodiment example illustrated in FIG. 2, it is considered to use LED type light sources with conductive rods of different lengths.

In this first example, during an initial supply step S1, a glass fiber panel covered on either side with a conductive plate for example made of copper is obtained.

This is also referred to as a sandwich panel.

Thus, it is understood that the glass fiber panel, which is an insulating material, forms an insulating layer 13 acting as an electrical insulator between an upper conductive layer 11 and a lower conductive layer 12 (the copper plates).

In the second embodiment example illustrated in FIGS. 5A and 5B, it is considered to use SMD LED type light sources with flat electrical terminals.

In this second example, a PCB type multilayer panel is used with as for the first example an intermediate insulating layer 13 acting as an insulating layer between an upper conductive layer 11 and a lower conductive layer 12 and two insulating layers 17 and 18 sandwiching the whole 11-12-13. The layers 12 and 12 are so-called central layers.

This multilayer structure has numerous examples such as for example ensuring an optimal distribution of the electrical load on the two central layers 11 and 12 to be able to wire all of the LEDs without creating hot spots as well as the possibility of creating bands to find the + and the – according to bands on the lower layer.

As illustrated in FIGS. 2 and 5A-5B, the LED sources (or more generally the light sources) will be positioned at the front 10*a* of the support plate 10, i.e., on the upper layer 11 side.

It is desirable for the two layers 11 and 12 which are at different heights to be electrically connected to one another. More specifically, the two layers 11 and 12 are wired to the same electrical generator 40.

In each of the two examples described herein, a vertical wiring structure is considered wherein the two terminals 21 and 22 of each LED 20 are electrically connected with respectively each of the two layers 11 and 12.

Thus, as illustrated in FIG. 2 or 5, during the manufacturing process, an electrical connection step S5 is considered, during which the first 21 and second 22 electrical terminals of each light source 20 are electrically connected respectively to the upper 11 and lower 12 layers.

To carry out such so-called vertical wiring, the manufacturing method considers beforehand specific machining of the support plate 10.

In the two examples described, the plate will be machined such that each LED source 20 can come into contact with one of the two conductive layers 11 or 12 selectively.

Three machining steps S2, S3 and S4 are particularly considered, which will enable a vertical wiring for each LED source 20 to be designed.

In the two examples described, the use of a CNC type numerical control cutting machine which will machine the support plate 10 specifically is preferably considered.

This CNC machine will be controlled automatically or semi-automatically thanks in particular to a layout generated during a step S0. During this step S0, a computer file readable by the CNC machine will be generated particularly according to the desired shape and various predetermined constraints. This file then contains the layer with particularly the position and the orientation of each LED source.

In each of the two examples described herein, the support plate 10 is therefore machined during a step S2 to form a first hole 14 according to the layout (orientation and position, in particular).

In the example illustrated in FIG. 2, this first hole 14 is machined so as to open onto the front 10*a* and traverse at least partially the upper layer 11.

In the example described herein, this first hole 14 is moreover sized to receive the first electrical terminal 21, herein the shortest conductive rod.

In the example illustrated in FIGS. 5A and 5B, the terminals 21-22 of the light source 20 are flat. It is considered herein that this first hole 14 is machined so as to open onto the front 10*a* and traverse at least partially the upper layer 11 and the first insulating layer 17.

Then, the plate is machined during a step S3 to form a second hole 15, again according to the layout.

In the example illustrated in FIG. 2, this second hole 15 is machined so as to open onto the front 10*a* and traverse the upper layer 11, the insulating layer 13 and at least partially the lower layer 12.

In the example described herein, this second hole 15 is sized to receive the second electrical terminal 22.

In the example illustrated in FIG. 2, this second hole 15 is machined so as to open onto the front 10*a* and traverse the first insulating layer 17, the upper layer 11, the insulating layer 13 and at least partially the lower layer 12.

Finally, during a step S4 the support plate 10 is machined so as to form a third, so-called blind, hole 16.

As illustrated in FIG. 2 or 5A-5B, this blind hole 16 is machined so as to open onto the front 10*a* and traverse the upper layer 11 and at least partially the insulating layer 13 (and the first insulating layer 17 for the example in FIG. 5)

In the example described herein, this blind hole 16 is centered on the second hole 15 (coaxial therewith) and has a greater diameter than that of the second hole 15.

The same blind hole 16 is also found in the embodiment example in FIGS. 5A-5B.

These machining operations are repeated according to the layout for each LED source. Thus, it is understood that by producing according to the layout these holes 14, 15 and 16 with different diameters and depths, it is possible to reach the conductive layers 11 and 12 so as to establish an electrical connection with each conductive terminal 21 and 22 of the LED source 20.

The machining of the blind hole 16 enables the longest pole from the lower layer to be insulated.

When positioning the LED sources 20, the holes 14, 15 and 16 produced during the machining operations S2, S3 and S4 are therefore used. The LED sources 20 are then disposed one by one on the support plate 10 at the location defined during machining. The LED sources 20 are therefore positioned upside down so as to have the conductive poles thereof accessible and in contact with the sandwich panel 10.

It will be noted herein that there are numerous LED components compatible with this manufacturing process, all 3 or 5 millimeter diameter through LEDs, but also individual micromodules receiving an SMD type LED.

Figure 3:
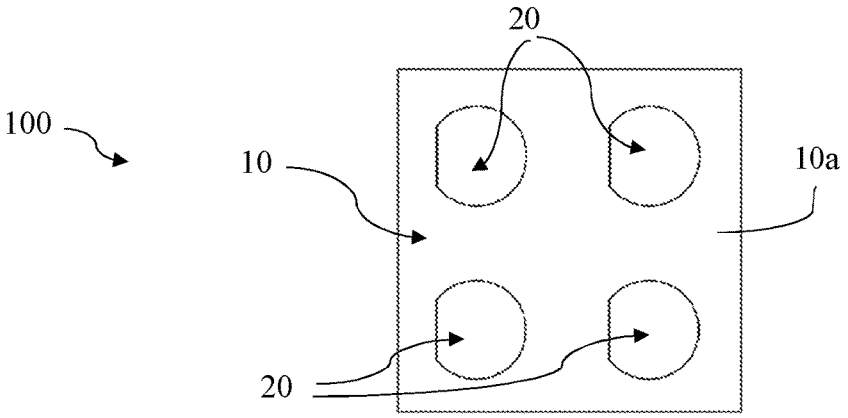
FIG. 3 represents schematically a top view of a lighting fixture having a support plate whereon the LED type light sources are wired according to an embodiment example according to FIG. 2.
Figure 4:
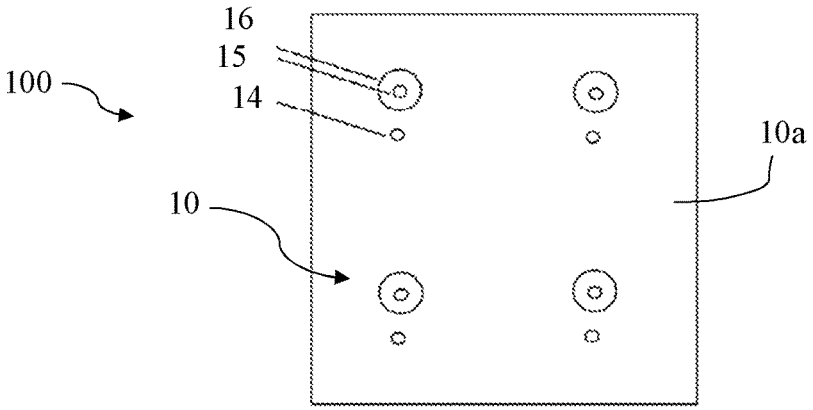
FIG. 4 represents a schematic top view of a support plate according to FIG. 2 with no light source.

In the first example described herein and illustrated in FIGS. 2, 3 and 4, the electrical connection S5 is therefore carried out by inserting the first terminal 21 of the source 20 into the first hole 14 (the shortest conductive rod). In this way, an electrical contact point 21*a* is established between the light source 20 and the upper layer 11.

In this configuration and as illustrated in FIG. 2, it is understood that the first terminal 21 of the LED source 20 is electrically insulated from the lower layer 12.

During the connection S5, the second terminal 22 (the longest conductive rod) of the source 20 is then inserted into the second hole 15 in order to establish an electrical contact point 22*a* between the light source 20 and the lower layer 12.

Thanks to the diameter of the blind hole 16, the second terminal 22 of the LED source 20 is electrically insulated from the upper layer 11.

At each electrical contact point 21*a* and 22*a* (i.e., twice per LED), a drop of conductive adhesive is then deposited during the electrical connection S5.

In the example described herein, an epoxy type adhesive mixed with microparticles of conductive material based on silver or tin for example is used.

Therefore, half of the drops are in contact with the upper layer and the other half are in contact with the lower layer.

Preferably, this adhesive must be prepared with the correct conductivity so as not to oppose an excessively high electrical resistance and with the correct viscosity so as not to move during the procedure.

After applying and drying S6 the adhesive, during a step S7 the two conductive layers 11 and 12 are supplied using electrical power supply means 40 with direct current to supply all the LED sources 20 in parallel.

In the example described herein, the LED sources used are 3.3 Volt LEDs. In this example, it is preferable to supply these two layers with 3.3 Volt direct current.

It is also possible to use LED sources which are directly considered to be supplied with 12 Volts. In this case, this electrical assembly can be supplied directly with 12V.

In the second example described herein and illustrated in FIGS. 5A-5B, the electrical contact points 21*a* and 22*a* between the conductive layers 11 and 12 and the source are used by electrical bridges 19*a* and 19*b* which are introduced respectively into the first 14 and second 15 holes. Once the bridges 19*a* and 19*b* have been introduced into each of the respective holes, a resin is poured into each of said holes 14 and 15. This resin then forms an insulating sheath suitable for ensuring electrical insulation of the bridges.

The electrical contact points 21*a* and 22*a* between the terminals of the electrical source 20 and each of the layers 11 and 12 are thus used at the front 10*a* via the bridges. In this second example, the electrical connection of each of the terminals 21 and 22 of the light source with the layers 11 and 12 is carried out by a solder. Such a solder can be used for example by depositing an addition of material such as soldering paste followed by a passage in a furnace to secure the terminals to the plate.

In each of the examples, the LED sources are then placed on the pre-machined support plate 10 to receive each LED with a predefined position and orientation.

This position and this orientation of the LED sources 20 are defined according to a layout during an initial step S0. Such a layout can be generated automatically with dedicated computer software according to the shape of the desired lighting.

Once the layout has been generated, one or more plates forming a sandwich type panel having on the lower and upper surface thereof a conductive material and an insulating material at the core thereof are prepared. This plate is perforated during the machining to supply the LED sources 20 with the positive or negative conductive layer.

The advantage of further having a first and an example insulating layer sandwiching the whole is that of ensuring an optimal distribution of the electrical load on the two central layers to be able to wire all of the LEDs without creating hot spots. This multilayer configuration also enables bands to be created to find the + and the − according to bands on the lower layer.

Then, drops of conductive adhesive 31 are disposed on the support plate for each contact point 21*a* and 22*a* with the LED 20.

The two parts are then assembled to obtain a complete electrical circuit supplying all the LED sources of the shape at once. Each LED is therefore supplied in parallel individually.

The layout of the LEDs consists of disposing imperfect circles in a shape. This part can therefore be the subject of computerized automation supplying the machine with the constraints in respect of spacing with the edge of the shape and spacing between the circles, in other words, between the LEDs.

The layout can therefore be generated electronically automatically or semi-automatically based on the drawing of the shape to be produced.

It is therefore no longer necessary to decide the location of each element such as the modules, the LEDs, or the resistors manually, or to decide the electrical wiring to connect these electrical components to one another.

All of the manufacturing steps described in the section can be automated to a greater or lesser degree. It is therefore possible to benefit from all the advantages of the individual positioning method while reducing the labor to achieve same very considerably.

The automation of this manufacture should enable this production to be located in countries with a high labor cost and therefore bring the production closer to the centers of consumption of this product. This also gives rise to lower shipping costs and shorter lead times.

Finally, the manufacturing method also enables the manufacturing of the signs to be accelerated and therefore have a competitive advantage in terms of production lead time compared to the competition producing these products manually.

It should be observed that this detailed description relates to a specific embodiment example of the present invention, but this description is in no way limiting in relation to the subject matter of the invention; on the contrary, it is intended to remove any imprecision or any incorrect interpretation of the following claims.

It should also be observed that the reference signs placed between parentheses in the following claims are in no way limiting; these signs are solely intended to improve the intelligibility and the comprehension of the following claims as well as the scope of the desired protection.

The invention claimed is:

1. A lighting fixture comprising:

a support plate; and a plurality of light sources positioned at the front of the support plate, said light sources each having at least a first and a second electrical terminal, said support plate comprises a glass fiber panel having an upper copper conductive layer and a lower copper conductive layer, said upper and lower layers being electrically insulated from one another by the glass fiber panel operating as an insulating layer, and in that, for each light source, the first and second electrical terminals are electrically connected respectively to the upper copper conductive and lower copper conductive layer, or conversely.

2. The fixture according to claim 1, wherein said support plate includes, for each light source, a first hole opening onto the front of said support plate and traversing at least partially said upper copper conductive layer.

3. The fixture according to claim 2, wherein said first hole is sized to receive said first or second electrical terminal in order to establish an electrical contact point between said light source and said upper copper conductive layer.

4. The fixture according to claim 2, wherein said support plate further comprises at the front a first insulating layer, said upper copper conductive layer being sandwiched between the insulating layer and the first insulating layer, and wherein said first hole traverses said first insulating layer to open onto the front.

5. The fixture according to claim 4, wherein said first hole is sized to receive said first or second electrical terminal in order to establish an electrical contact point between said light source and said upper copper conductive layer, and wherein a first electrical bridge is housed inside said first hole, said first electrical bridge electrically connecting said upper copper conductive layer to the front to establish at the front an electrical contact point between said first or second electrical terminal of said light source and said upper copper conductive layer.

6. The fixture according to claim 5, further comprising fastening means having conductivity properties are used at the level of each of the electrical contact points to secure each of said light sources on said support plate while ensuring electrical conductivity between each of said sources and respectively the upper and lower copper conductive layers.

7. The fixture according to claim 6, wherein the fastening means include an epoxy type conductive adhesive mixed with conductive particles such as for example silver or tin in particular.

8. The fixture according to claim 6, wherein the fastening means include a solder.

9. The fixture according to claim 5, wherein said first electrical bridge is electrically insulated by an insulating sheath.

10. The fixture according to claim 1, wherein said support plate further comprises, for each light source, a second hole opening onto the front of said support plate and traversing said copper conductive upper layer, said insulating layer and at least partially said lower copper conductive layer.

11. The fixture according to claim 10, wherein said support plate has a third, blind, hole, opening onto the front and traversing at least said upper layer and at least partially said insulating layer, said blind hole being substantially centered on said second hole and having a greater diameter than said second hole so as to electrically insulate said upper layer and said second or first electrical terminal electrically connected to the lower layer.

12. The fixture according to claim 10, wherein said second hole is sized to receive said second or first electrical terminal in order to establish an electrical contact point between said light source and said lower copper conductive layer.

13. The fixture according to claim 1, wherein said support plate further comprises at a back a second insulating layer, said lower copper conductive layer being sandwiched between the insulating layer and said second insulating layer.

14. The fixture according to claim 13, wherein said support plate includes, for each light source, a second hole opening onto the front of said support plate and traversing said upper layer, said insulating layer and at least partially said lower copper conductive layer, and wherein a second electrical bridge is housed inside said second hole, said second electrical bridge electrically connecting said lower copper conductive layer to the front to establish at the front an electrical contact point between said second or first electrical terminal of said light source and said lower copper conductive layer.

15. The fixture according to claim 14, wherein said second electrical bridge is electrically insulated by an insulating sheath.

16. The fixture according to claim 1, wherein the first and second electrical terminals of each of the light sources are electrically insulated respectively from the lower and upper copper conductive layers, or conversely.

17. The fixture according to claim 1, further comprising electrical power supply means respectively connected to the upper and lower copper conductive layers to supply each of said light sources with direct current.

18. The fixture according to claim 1, wherein the light sources include at least one LED type light-emitting diode and/or an individual module receiving an SMD LED type light-emitting diode.

19. The fixture according to claim 1, wherein the light sources are positioned according to a defined layout to form a predetermined lighting pattern.

20. The fixture according to claim 1, wherein each light source is presented in the form of an electronic component configured to withstand a voltage of 12 Volts and including an individual LED and a micro-resistor, encapsulated in a resin capsule.

21. A method for manufacturing a lighting fixture having a plurality of light sources positioned at the front of a support plate, each light source having at least a first and a second electrical terminal, said method comprising:

providing a support plate comprising an upper copper conductive layer and a lower copper conductive layer, said upper and lower layers being electrically insulated from one another by an intermediate glass fiber panel operating as an insulating layer, and an electrical connection step during which the first and the second electrical terminals of each light source are electrically connected respectively to the upper and the lower copper conductive layers, or conversely.

22. The method according to claim 21, further comprising, prior to the electrical connection step, a first machining step during which said support plate is machined so as to form a first hole opening onto the front and traversing at least partially said upper copper conductive layer.

23. The method according to claim 22, further comprising, prior to the electrical connection step, a second machining step during which said support plate is machined so as to form a second hole opening onto the front and traversing said upper layer, said insulating layer and at least partially the lower copper conductive layer.

24. The method according to claim 23, wherein the electrical connection step includes the use at the level of each of the electrical contact points of fastening means to secure each of said sources on said support plate while ensuring electrical conductivity between each of said sources and respectively the upper and lower copper conductive layers.

25. The method according to claim 23, further comprising a third machining step during which said support plate is machined so as to form a third, so-called blind, hole, opening onto the front and traversing said upper layer and at least partially said insulating layer, said blind hole being substantially centered on said second hole and having a greater diameter than that of the second hole so as to electrically insulate said upper copper conductive layer and said second or first electrical terminal electrically connected to the copper conductive lower layer.

26. The method according to claim 21, wherein the electrical connection step includes the electrical insulation of the first and second electrical terminals of each light source with respectively the lower and upper copper conductive layers, or conversely.

27. A use of a lighting fixture device according to claim 1, for an illuminated sign.

* * * * *